US007377508B2

(12) United States Patent
Rhoads et al.

(10) Patent No.: US 7,377,508 B2
(45) Date of Patent: May 27, 2008

(54) PICK MECHANISM AND ALGORITHM FOR AN IMAGE FORMING APPARATUS

(75) Inventors: Christopher E. Rhoads, Georgetown, KY (US); John Spicer, Lexington, KY (US); Darin M. Gettelfinger, Lexington, KY (US); Scott S. Williams, Versailles, KY (US); Michael W. Lawrence, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 334 days.

(21) Appl. No.: 10/436,406

(22) Filed: May 12, 2003

(65) Prior Publication Data

US 2004/0245701 A1 Dec. 9, 2004

(51) Int. Cl.
*B65H 3/06* (2006.01)

(52) U.S. Cl. ..... 271/116

(58) Field of Classification Search ..... 192/219.3, 192/27, 38, 44, 45, 54.52, 56.33, 56.43, 56.54, 192/56.57, 56.62, 69.5, 46.57, 54, 52; 271/116
See application file for complete search history.

(56) References Cited

U.S. PATENT DOCUMENTS

| | | | | | |
|---|---|---|---|---|---|
| 90,992 | A | * | 6/1869 | Cardot | 192/45 |
| 109,299 | A | * | 11/1870 | Goldwell | 192/45 |
| 116,413 | A | * | 6/1871 | Close | 192/45 |
| 360,393 | A | * | 3/1887 | Rogers | 192/45 |
| 1,362,011 | A | * | 12/1920 | Kirby | 192/45 |
| 1,719,881 | A | * | 7/1929 | Farmer | 192/45 |
| 2,232,090 | A | * | 2/1941 | Anderson | 192/45 |
| 3,040,853 | A | | 6/1962 | Svendsen | |
| 3,503,490 | A | | 3/1970 | Heyne | |
| 3,606,938 | A | | 9/1971 | Heyne | |
| 3,645,527 | A | * | 2/1972 | Gates | 271/42 |
| 4,320,953 | A | | 3/1982 | Schultes et al. | |
| 4,411,511 | A | | 10/1983 | Ariyama et al. | |
| 4,544,294 | A | * | 10/1985 | Runzi | 400/636.2 |
| 4,548,316 | A | | 10/1985 | Maurer | |
| 4,566,684 | A | | 1/1986 | Gysling | |
| 4,577,849 | A | | 3/1986 | Watanabe | |
| 4,580,917 | A | | 4/1986 | Hibino | |
| 4,589,765 | A | | 5/1986 | Perun et al. | |
| 4,660,821 | A | | 4/1987 | Boser et al. | |
| 4,682,769 | A | | 7/1987 | Murakami et al. | |
| 4,744,687 | A | | 5/1988 | Nukaya et al. | |
| 4,766,463 | A | | 8/1988 | Watanuki et al. | |
| 4,790,524 | A | | 12/1988 | Murakami et al. | |
| 4,809,969 | A | | 3/1989 | Bastow et al. | |
| 4,865,305 | A | | 9/1989 | Momiyama et al. | |
| 4,868,609 | A | | 9/1989 | Nagata et al. | |
| 4,884,796 | A | | 12/1989 | Daboub | |

(Continued)

*Primary Examiner*—Patrick Mackey
*Assistant Examiner*—Jeremy R Severson
(74) *Attorney, Agent, or Firm*—Coates & Bennett, PLLC

(57) ABSTRACT

A pick mechanism, having a clutch mechanism, for picking media sheets from an input tray and introducing them into a paper path of an image forming apparatus. The clutch mechanism comprises a plurality of balls positioned between an inner race and an outer race. Angular backlash between the inner race and the outer race may result in variations in the timing of the media sheets. An algorithm is further included to estimate the pick timing of the media sheets. The algorithm calculates an estimated pick time for a subsequent media sheet that incorporates the known engagement variations of the ball clutch pick mechanism.

19 Claims, 8 Drawing Sheets

U.S. PATENT DOCUMENTS 4,900,003 A 2/1990 Hashimoto
4,990,011 A 2/1991 Underwood et al.
5,056,771 A 10/1991 Beck et al.
5,121,914 A 6/1992 Hargreaves
5,121,915 A 6/1992 Duncan et al.
5,141,217 A 8/1992 Lim et al.
5,147,020 A 9/1992 Scherman et al.
5,169,136 A 12/1992 Yamagata et al.
5,195,737 A 3/1993 Ifkovits, Jr. et al.
5,197,726 A 3/1993 Nogami
5,253,856 A 10/1993 Fuchi et al.
5,277,415 A 1/1994 Kinoshita et al.
5,390,773 A * 2/1995 Proia ..... 192/45
5,393,044 A 2/1995 Hagihara et al.
5,423,527 A 6/1995 Tranquilla
5,428,431 A 6/1995 Abe et al.
5,465,955 A 11/1995 Krupica et al.
5,495,326 A 2/1996 Mikida
5,501,444 A 3/1996 Yukimachi et al.
5,507,478 A 4/1996 Nottingham et al.
5,547,181 A 8/1996 Underwood
5,558,193 A 9/1996 Jenkins et al.
5,580,046 A 12/1996 Beaufort et al.
5,651,538 A 7/1997 Chung et al.
5,667,215 A 9/1997 Yoshino
5,692,741 A 12/1997 Nakamura et al.
5,826,135 A 10/1998 Lee
5,878,321 A 3/1999 Miyazaki et al.
5,884,135 A 3/1999 Moore
6,076,821 A 6/2000 Embry et al.
6,170,816 B1 1/2001 Gillmann et al.
6,293,537 B1 9/2001 Park
6,330,424 B1 12/2001 Chapman et al.
6,382,618 B1 5/2002 Takada
6,390,467 B1 5/2002 Fukube
6,446,954 B1 9/2002 Lim et al.
6,454,069 B2 * 9/2002 Oh ..... 192/45
6,519,443 B1 2/2003 Coriale et al.
6,527,097 B2 3/2003 Dreyer
6,644,452 B2 * 11/2003 Lew et al. ..... 192/64
6,679,490 B2 1/2004 Pioquinto et al.
6,736,389 B2 5/2004 Kosmoski
6,955,252 B2 * 10/2005 Allport ..... 192/44
2005/0092572 A1 5/2005 Kuo

* cited by examiner

PICK MECHANISM AND ALGORITHM FOR AN IMAGE FORMING APPARATUS

BACKGROUND

Many types of image forming devices pick a media sheet from a storage location and move the media sheet to an imaging location for receipt of a toner image. The timing of the media sheet relative to the imaging location is important for adequate toner image receipt and image formation. Improper timing results in top writing line margin error with the toner image positioned at the wrong location relative to the top margin of the media sheet.

Expected time allocations are used to determine the timings for picking a media sheet from an input tray such that it reaches a transfer point to receive the toner image. Deviations from the expected times require additional demand on the system and may result in inadequate image formation.

One deviation in the expected time allocations is caused by the friction of the pick mechanism as the media sheet leaves the input tray. The pick mechanism contacts the media sheet at the input tray and transports the sheet a distance where it is introduced and driven by the paper path. At the introduction point into the paper path, the media sheet may still be in contact with the pick mechanism. The pick mechanism may impede the movement of the sheet by the paper path resulting in the sheet moving slower than expected and thus deviating from the expected time.

The Model Z65 printer available from Lexmark International, Inc. uses a ball-clutch design for picking media sheets from an input tray. The Z65 ball-clutch includes a one ball—two pocket design which reduces or prevents friction on the media sheet when controlled by two separate sections of the paper path. However, the ball-clutch causes deviations in the amount of time necessary to pick the media sheet from the input tray. The Z65 printer is able to use a ball clutch because image transfer on Z65 does not occur until the media sheet is in the proper position (i.e., the media sheet reaches the transfer point prior to the imaging). Therefore, pick timings for Z65 printer are not as critical and deviations of the one ball—two pocket design can be accounted for. Serial printers which feature toner image formation on an intermediate mechanism which intersect a media sheet at a transfer point require more critical timing because the imaging operation may start before the media reaches any sensors in the paper path. Any variation in the pick timings translate into top writing line margin error that should be corrected by the printer before the media sheet reaches the transfer point. Only a finite amount of error can be corrected.

SUMMARY

The present invention is directed to a ball-clutch pick mechanism and an algorithm for moving media sheets from an input tray into the media path. The term "input tray" is a general term and may include various types of storage positions. The ball clutch includes an inner race, and outer race, and a plurality of balls positioned between the two. The inner race is sized to rotate within the outer race. The dimensions of the inner race and outer race cause one or more of the balls to become engaged, contact both the inner race and outer race simultaneously, and prevent the inner race from rotating freely relative to the outer race. This results in the driving rotation of the inner race to be transferred to the outer race. The outer race is operatively connected to a pick tire that contacts a topmost media sheet within the input tray. Rotation of the outer race is transferred to the pick tire which in turn begins moving the media sheet out of the input tray and into the paper path.

The shapes of the inner race, outer race, and balls also allow for the outer race to rotate at a different rate than the inner race. In one embodiment, the outer race rotates at a faster rate than the inner race. This is necessary when the media sheet leaves the input tray and is contacted simultaneously by both the pick mechanism and rollers of the paper path. At this time, the pick mechanism is moving the media sheet at a first rate, and the paper path is moving the media sheet at a second rate different than the first. The clutch mechanism provides for the outer race to rotate at a different rate than the inner race.

This design has many advantages over prior art designs. The reduction of clutch friction reduces the drag on the media sheet as it is being picked to reduce the amount of skew and also reduce the amount of wear on the pick tires. Another advantage is the pick arm is not lifted as high which reduces bounce times of the arm falling back onto the media stack. Additionally, the ball clutch can withstand larger part tolerances than many prior art designs, such as a spring clutch.

An algorithm is further included to estimate the time to move a subsequent media sheet from the input tray to a predetermined position on the paper path. In one embodiment, the algorithm calculates an estimated pick time with the assumption of maximum angular backlash such that the estimate pick time is usually greater than the actual pick time. This causes the media to usually reach the predetermined position on the paper path simultaneously or earlier than the corresponding image position on the intermediate transfer medium. In one embodiment, the actual pick times are limited to be within a predetermined window.

DETAILED DESCRIPTION

Figure 1:
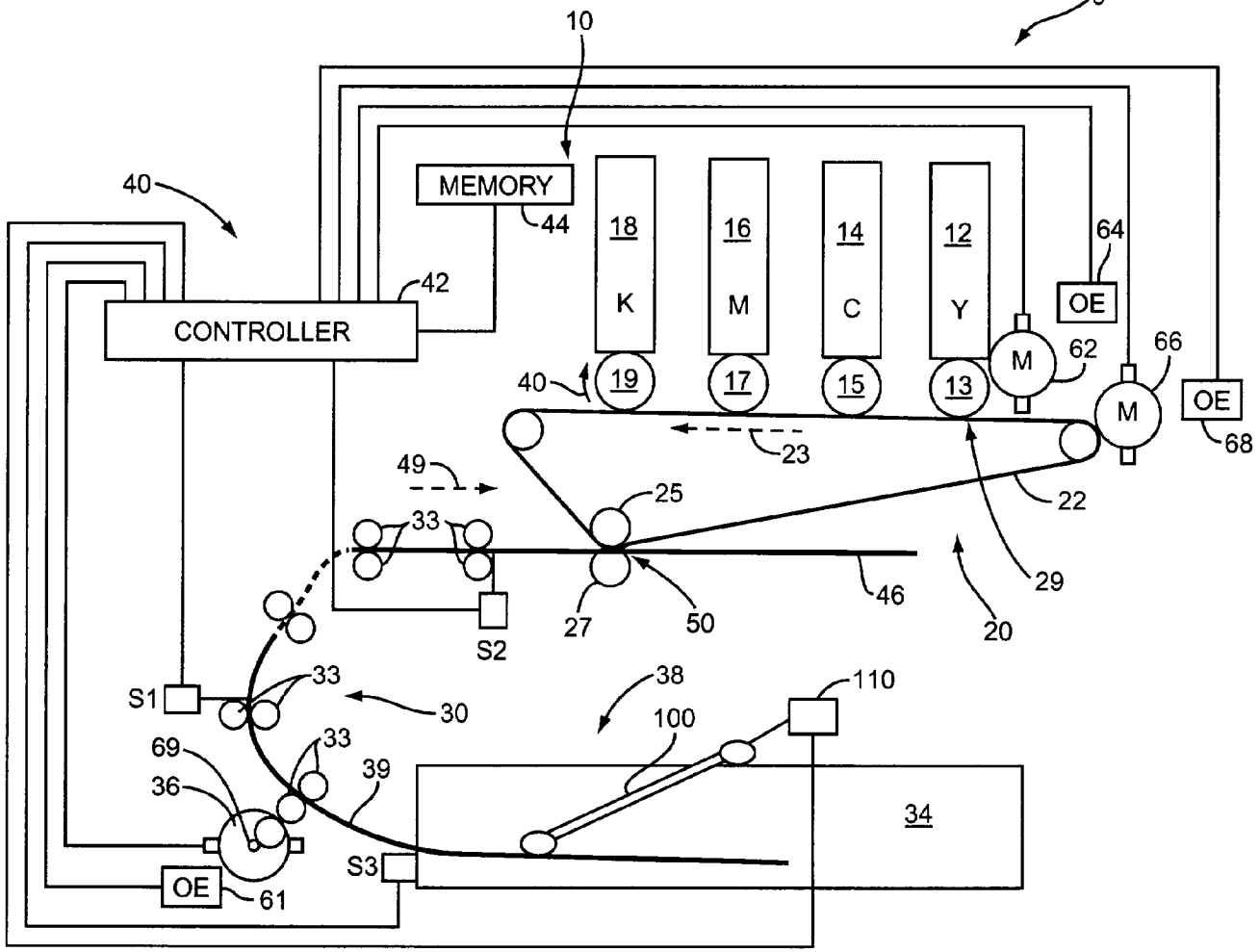
FIG. 1 is a schematic view illustrating one embodiment of an image forming apparatus.

FIG. 1 illustrates one embodiment of an image forming device 9 which includes a toner image forming section 10, an intermediate section 20, a media moving section 30, an input section 38, and a controller 40. One embodiment as illustrated in FIG. 1 is a color laser printer. The present invention is also applicable to other types of image forming devices featuring an intermediate section for moving toner images and an input section and media moving section that move media to intercept the toner image.

Image forming section 10 includes a plurality of toner cartridges 12,14,16,18 each having a corresponding photoconductive drum 13, 15, 17, 19. Each toner cartridge has a similar construction but is distinguished by the toner color contained therein. In one embodiment, the device 9 includes a black cartridge 18, a magenta cartridge 16, a cyan cartridge 14, and a yellow cartridge 12. The different color toners form individual images in their respective color that are combined in layered fashion to create the final multicolored image.

Each photoconductive drum 13, 15, 17, 19 has a smooth surface for receiving an electrostatic charge from a laser assembly (not illustrated). The drums continuously and uniformly rotate past the laser assembly that directs a laser beam onto selected portions of the drum surfaces forming an electrostatic latent image representing the image to be printed. The drum is rotated as the laser beam is scanned across its length. This process continues as the entire image is formed on the drum surface.

After receiving the latent image, the drums rotate past a toner area having a toner bin for housing the toner and a developer roller for uniformly transferring toner to the drum. The toner is a fine powder usually composed of plastic granules that are attracted to the electrostatic latent image formed on the drum surface by the laser assembly.

Intermediate section 20 includes an intermediate transfer medium (ITM) belt 22 for receiving the toner images from each drum surface. As illustrated in FIG. 1, the ITM belt 22 is endless and extends around a series of rollers adjacent to the drums 13, 15, 17, 19 as it moves in the direction indicated by arrow 23. The ITM belt 22 and drums 13, 15, 17, 19 are synchronized providing for the toner image from each drum to precisely align in an overlapping arrangement. In one embodiment, a multi-color toner image is formed during a single pass of the ITM belt 22. By way of example as viewed in FIG. 1, the yellow (Y) toner is placed first on the ITM belt 22, followed by cyan (C), magenta (M), and black (K). In one embodiment, ITM belt 22 makes a plurality of passes by the drums to form the overlapping toner image.

ITM belt 22 moves the toner image towards a second transfer point 50 where the toner images are transferred to a media sheet. A pair of rollers 25, 27 form a nip where the toner images are transferred from the ITM belt 22 to the media sheet. The media sheet with toner image then travels through a fuser (not illustrated) where the toner is adhered to the media sheet. The media sheet with fused image is then either outputted from the image forming apparatus 9, or routed through a duplexer (not illustrated) for image formation on a second side.

Media moving section 30 comprises a paper path 39 having a series of nip rollers 33 spaced a distance apart and rotated to control the speed and position of each media sheet as it moves from the input section 38 to the second transfer point 50. One or more sensors S1, S2, S3, etc. are placed along the paper path 39 to determine the position of the media sheet. In one embodiment, sensors S1, S2, S3, etc. are optical sensors that detect a leading edge or trailing edge of the media sheet when passing the sensor location. Rollers 33 are operated by one or more motors 69 which control the speed the media sheets move along the paper path 39. The range of speeds of the rollers 33 can be adjusted by the controller 40. In one embodiment, the paper path 39 includes a single staging section. In one embodiment, a first section extends between sensor S1 and sensor S2, and a second section extends between sensor S2 and the second transfer point 50. In one embodiment, the media sheets are not sensed until reaching sensor S2. The rate of each of the sections can be adjusted as necessary for the media sheet to properly intercept the toner image at the second transfer point 50.

Input section 38 comprises an input tray 34 for holding a stack of media sheets, and a pick mechanism 100 for picking a topmost sheet from the stack and feeding it towards the media moving section 30. A drive assembly 110 is controlled by controller 40 to activate the pick mechanism 100.

Controller 40 oversees the timing of the toner images and the media sheets to ensure the two coincide at the second transfer point 50. In one embodiment as illustrated in FIG. 1, controller 40 includes a microcontroller 42 with associated memory 44. In one embodiment, controller 40 includes a microprocessor, random access memory, read only memory, and in input/output interface. Controller 40 monitors when the laser assembly begins to place the latent image on the photoconductive drums 13, 15, 17, 19, and at what point in time the first line of the toner image is placed onto the ITM belt 22. In one embodiment, controller 40 monitors scan data from the laser assembly and the number of revolutions and rotational position of drum motor 62 that drive the photoconductive drums 13, 15, 17, 19. In one embodiment, a single drum motor 62 drives each of the photoconductive drums 13, 15, 17, 19. In one embodiment, two or more drum motors drive the plurality of photoconductive drums. In one embodiment, the number of revolutions and rotational position of drum motor 62 is ascertained by an encoder 64.

In one embodiment, as the first writing line of the toner image is transferred onto the ITM belt 22, controller 40 begins to track incrementally the position of the image on ITM belt 22 by monitoring the number of revolutions and rotational position of belt motor 66. An encoder 68 ascertains the number of revolutions and rotational position of the belt motor 66. From the number of rotations and rotational position of the belt motor 66, the linear movement of ITM belt 22 and the image carried thereby can be directly calculated. Since both the location of the image on ITM belt 22 and the length of belt between the first drum transfer nip 29 and second transfer point 50 is known, the distance remaining for the toner images to travel before reaching the second transfer point 50 can also be calculated.

In one embodiment, the position of the image on the ITM belt 22 is determined by HSYNCs that occur when the laser assembly makes a complete scan over one of the photoconductive drums. Controller 40 monitors the number of HSYNCs and can calculate the position of the image. In one embodiment, one of the colors, such as black, is used as the HSYNC reference for determining timing aspects of image movement. The HSYNCs occur at a known periodic rate and the ITM belt surface speed is assumed to be constant.

In one embodiment, at some designated time, pick mechanism 100 receives a command from the controller 40 to pick a media sheet. The media sheet moves through the beginning of the paper path 39 and eventually trips a paper path sensor S1. Controller 40 immediately begins tracking incrementally the position of the media sheet by monitoring the feedback of encoder 61 associated with paper path motor 69. The remaining distance from the media sheet to the second transfer point 50 can be calculated from the known distance between S1 and second transfer point 50 and feedback from the encoder 61. One embodiment of a similar system is disclosed in U.S. Pat. No. 6,330,424, assigned to Lexmark International, Inc., and herein incorporated by reference in its entirety.

Figure 2:
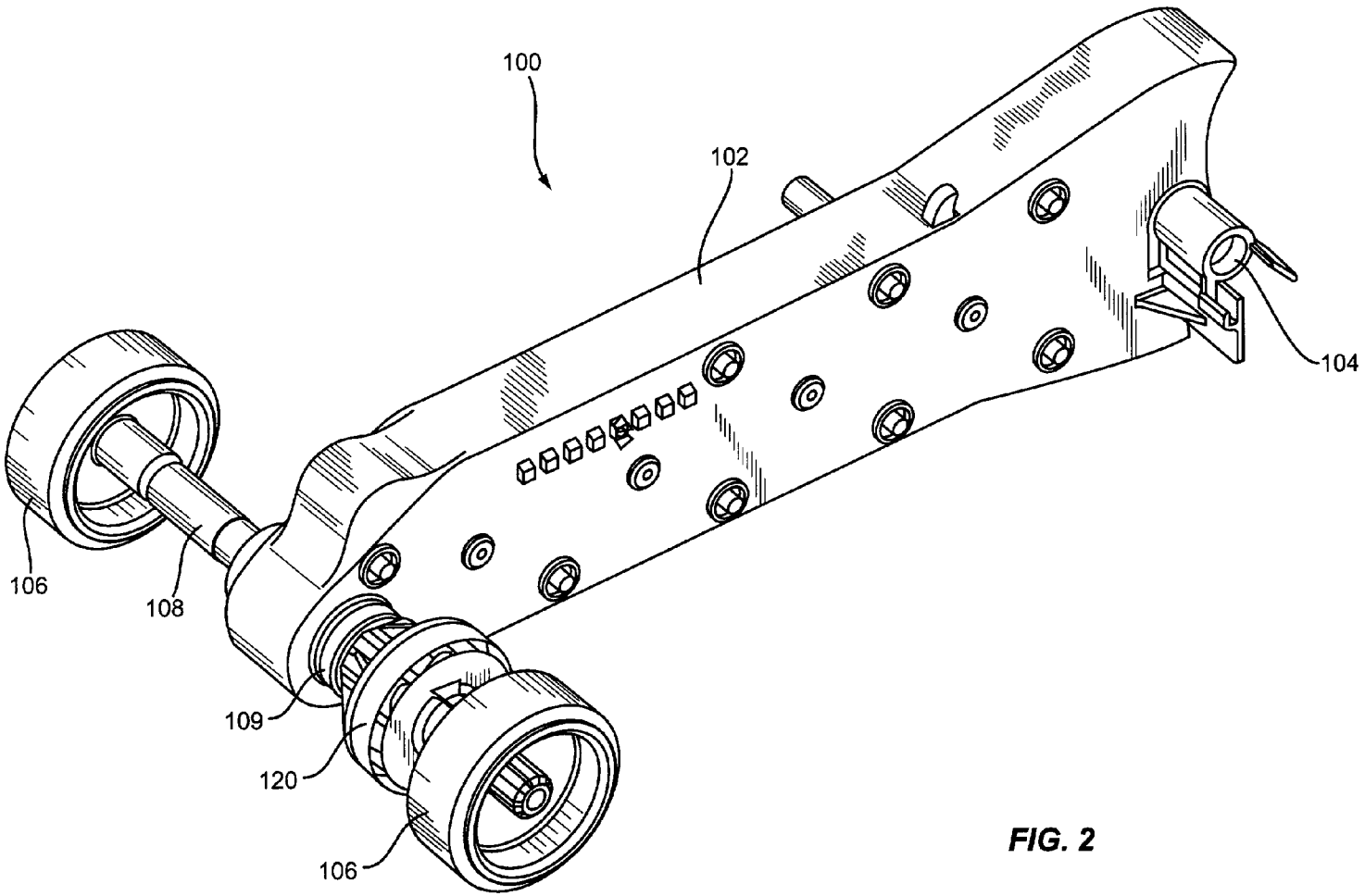
FIG. 2 is a partial perspective view illustrating one embodiment of a pick mechanism.

FIG. 2 illustrates one embodiment of the pick mechanism 100 within the input section 38. Pick mechanism 100 includes an arm 102 pivotally mounted to the device 9 at pivot 104. Arm 102 is positioned over the input tray 34 with the pick tires 106 contacting the topmost media sheet. A drive assembly 110 (FIG. 1) rotates the pick tires 106 to move the topmost media sheet to be moved from the input tray 34 into the paper path 39.

Figure 3:
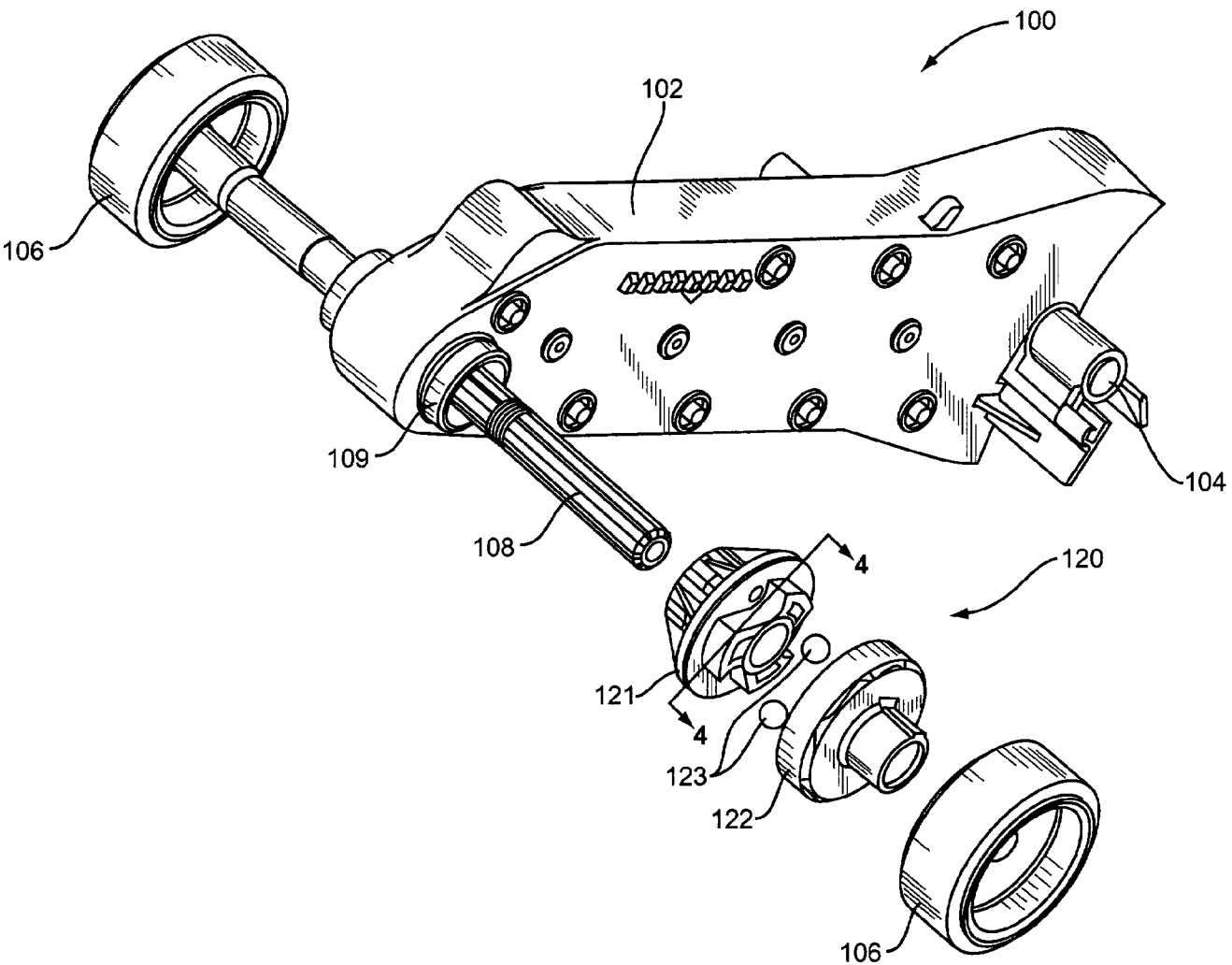
FIG. 3 is a partial perspective view of the pick mechanism of FIG. 2 with an inner race, balls, outer race, and pick tire in an exploded format.

FIG. 3 illustrates a partially exploded view of the pick mechanism 100 having an arm 102, drive member 109, shaft 108, clutch mechanism 120, and pick tires 106. The drive member 109 is positioned within the arm 102 and is rotated by the drive assembly 110. The shaft 108 extends through the drive member 109 but is not directly rotated by the drive member 109. The clutch mechanism 120 includes an inner race 121 attached to the drive member 109, and an outer race 122 connected to shaft 108. The inner race 121 is directly connected to the drive member 109 and rotation of the drive member 109 causes rotation of the inner race 121. The outer race 122 is connected to the inner race 121 through a plurality of balls 123. Note that the embodiment of FIG. 3 includes three balls 123, but one is obscured by the outer race 122 and not shown. In one embodiment, an odd plurality of balls (e.g., 3, 5, 7, etc.) are positioned within the clutch mechanism 120. Pick tires 106 and shaft 108 are operatively connected to the outer race 122.

The clutch mechanism 120 provides for the outer race 122, shaft 108, and pick tires 106 to rotate at a different rate than the drive member 109 and inner race 121. In one embodiment, the outer race rotates at a faster rate than the inner race. When the media sheet is being picked from the input tray 34, the rotation of the drive member 109 is transferred through the clutch mechanism 120 to the shaft 108 and pick tires 106. The surface friction between the pick tires 106 and media sheet causes the media sheet to move from the input tray 34 into the paper path 39.

When the media sheet is transferred to the paper path 39 and controlled by rollers 33, a section of the media sheet remains in contact with the pick tire 106 (i.e., the length of the media sheet is greater than the distance between the pick tires 106 and rollers 33). In one embodiment, rollers 33 move the media sheet at a rate faster than the pick mechanism 100. As a result, pick tires 106, shaft 108, and outer race 122 rotate at a rate faster than the inner race 121 and drive member 109. The clutch mechanism 120 disengages the pick tires 106 from the drive member 109 for free pick tire rotation and prevent interference with the rollers 33 moving the media sheet. Without the clutch mechanism 120, pick tires 106 would cause drag while sliding on the media sheet and possibly skew and/or slow the media sheet.

Figure 4:
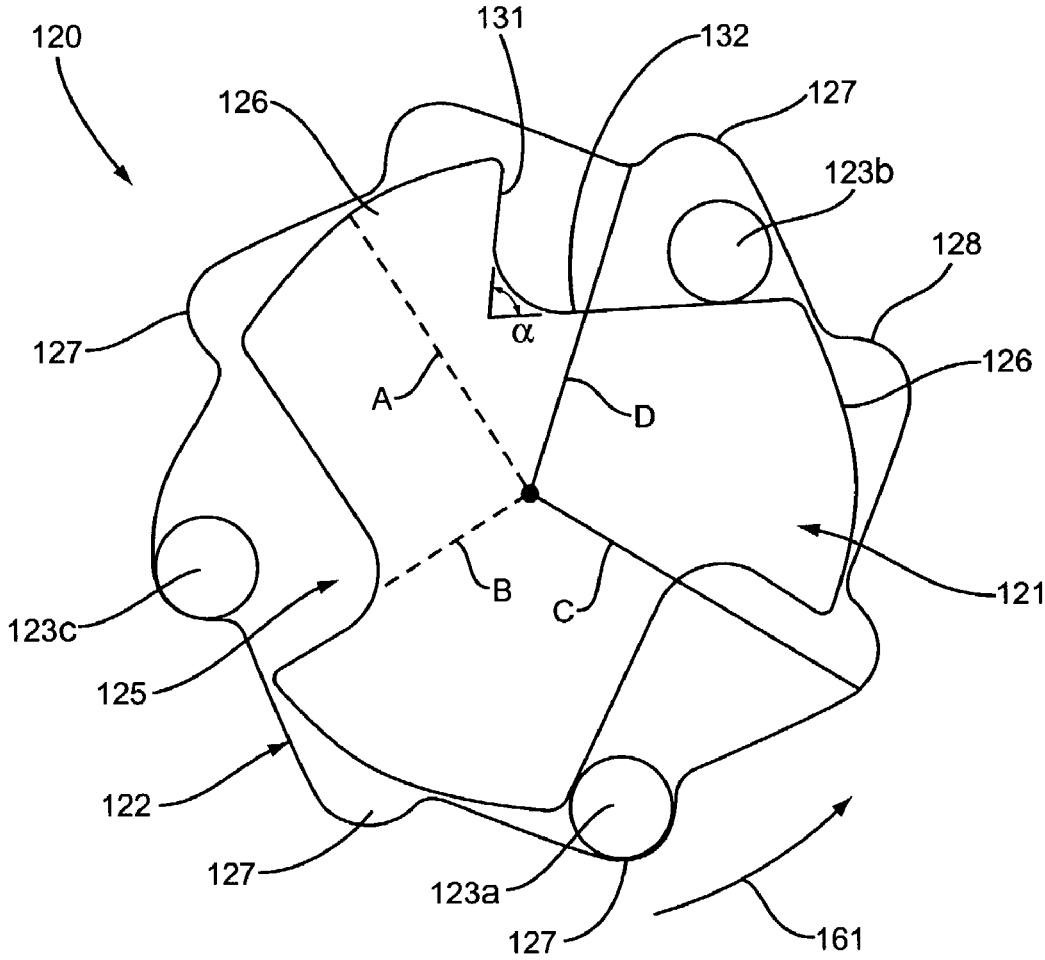
FIG. 4 is a schematic view of one embodiment of the outer race, inner race, and balls in a first orientation.

FIG. 4 illustrates a side view of one embodiment of the inner race 121, outer race 122, and balls 123*a*, 123*b*, 123*c* (referenced collectively as 123). Inner race 121 includes a series of extensions 126 and indents 125. In one embodiment, the number of indents 125 is equal to the number of balls 123. A distance from a center of the inner race 121 to the edge of extension 126 is defined as A. A distance from the center to the indent is defined as B. Outer race 122 has an edge forming a series of pockets 127. The dimensions of the outer race 122 vary between a distance from the center to a top of the pocket 127 defined as C, and a distance from the center to a bottom of the pocket 127 defined as D. A plurality of balls 123 are positioned between the inner race 121 and the outer race 122. In one embodiment, balls 123 have the same spherical size and shape.

The sizes of the inner and outer races 121, 122, and the balls 123 engage and disengage the shaft 108 and pick tires 106 relative to the drive member 109. During picking when the drive member 109 drives the shaft 108 and pick tires 106, the inner race 121 which is attached to the drive member 109 rotates in the direction of arrow 161. In this orientation, one or more balls 123 are positioned within the pockets 127 and contact both the inner race 121 and outer race 122. Hence, the rotation of the drive member 109 is distributed through the clutch mechanism 120 to the shaft 108 and pick tires 106. FIG. 4 illustrates one embodiment with ball 123*a* causing the rotation of the inner race 121 to drive the outer race 122. The inner race 121 cannot rotate past the pocket 127 because of the size of the ball 123 and depth of the pocket 127. In other words, distance A+diameter of ball>distance C.

When the media sheet is controlled by rollers 33 in the paper path 39, outer race 122 and pick tires 106 rotate at a rate greater than inner race 121. Rotation of the outer race 122 relative to the inner race 121 moves balls 123 towards the indents 125. Balls 123 are sized to fit within the indents 125 and not impede rotation of the outer race 122. In other words, distance B+diameter of ball<distance D.

Inner race 121 and outer race 122 are shaped to control the movement and positioning of the balls 123. In one embodiment, indents 125 include a first edge 131 and a second edge 132. This orientation causes the balls 123 to move towards the junction of the edges 131, 132 when the rate of the outer race 122 exceeds that of the inner race 121. In one embodiment, angle $\alpha$ formed by the edges 131, 132 is less than or equal to ninety degrees to prevent the ball 123 from moving out of the indent 125. In one embodiment, pockets 127 include a back edge 128 shaped to prevent the ball 123 from moving beyond the pocket 127 when pushed by edge 132.

Angular backlash between the inner race 121 and the outer race 122 causes variation in the pick timing which may lead to top margin writing line errors. Angular backlash is the amount of rotation of the inner race 121 prior to movement of the pick tire 106. In one embodiment, the outer race 122 is connected to the pick tire 106 in a manner that each rotate an equal amount when driven by the inner race 121. In this embodiment, angular backlash can be defined as the amount of rotation of the inner race 121 prior to engagement of the outer race 122. For an image forming apparatus as illustrated in FIG. 1, it is important that the media sheet reach the second transfer point 50 at a correct timing to meet the toner image on the ITM belt 22. A large amount of angular backlash causes the media sheet to be delayed during the pick and may result in the media sheet lagging behind the toner image at the second transfer point 50.

In FIG. 4, there is no angular backlash in the orientation of the inner race 121 and outer race 122. Ball 123*a* is locked in a first pocket, ball 123*b* is being pushed by the inner race 121 but will roll towards indents 125, and ball 123*c* is affected by gravity and is spaced away from the inner race 121. In this orientation, ball 123*a* causes the inner race to drive outer race 122. Balls 123*b* and 123*c* have no effect in this orientation. In this position, activation of the drive member 109 which rotates the inner race 121 would cause immediate rotation of the outer race 122 and pick tire 106 with no angular backlash.

Figure 5:
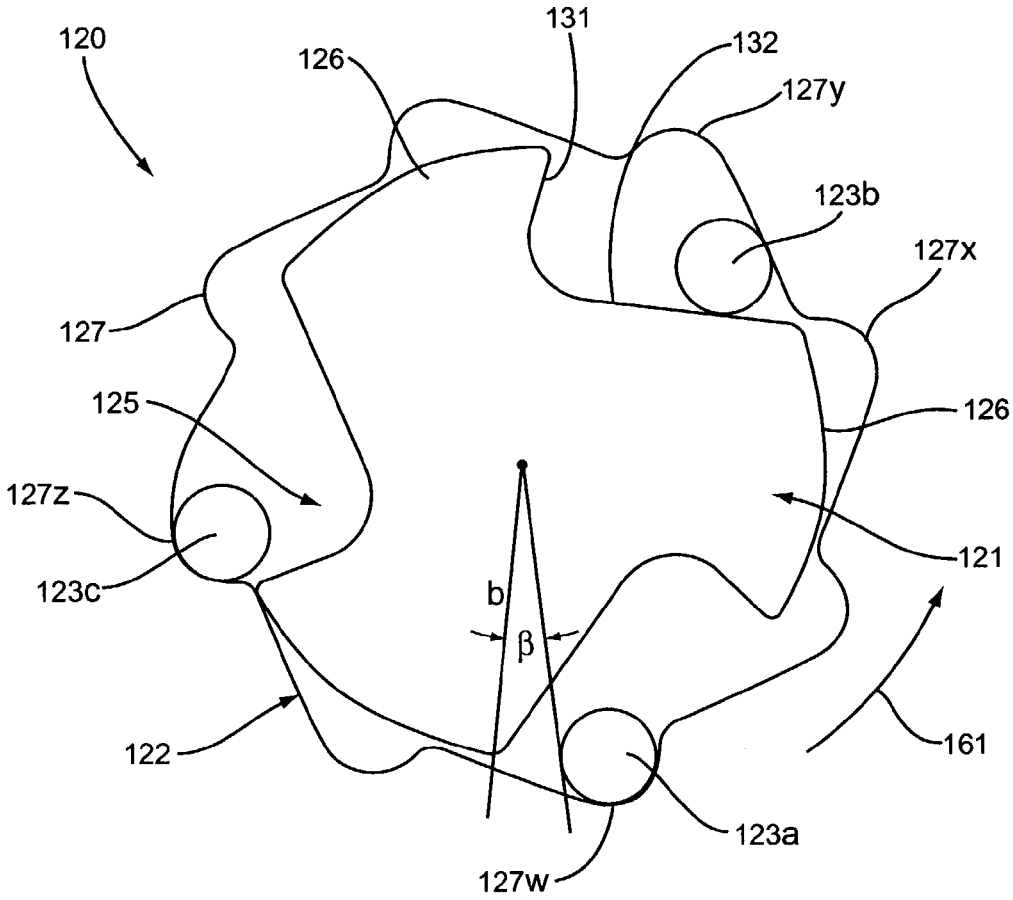
FIG. 5 is a schematic view of one embodiment of the outer race, inner race, and balls in a second orientation.

FIG. 5 illustrates an orientation having angular backlash. None of the balls 123*a*, 123*b*, 123*c* are locked in pockets 127 by the inner race 121. For ease of reference, pockets are collectively referred to as 127, and specifically as 127*w*,

127*x*, 127*y*, and 127*z*. There is separation between inner race 121 and ball 123*a* in pocket 127*w*. Ball 123*b* has moved beyond pocket 127*x* and is contacting inner race 121 but is distanced from pocket 127*y*. Ball 123*c* is in pocket 127*z* but distanced from inner race 121. Rotation of the inner race 121 will result in ball 123*a* being the first to contact both a pocket 127 and the inner race 121 such that rotation of the inner race 121 causes rotation of the outer race 122. As illustrated in FIG. 5, rotation of the inner race 121 of β° results in contact such that the inner race 121 drives the outer race 122. The deviation in pick timing is the amount of time necessary for the inner race 121 to rotate β°.

In one embodiment, the angular spacing of the pockets 127 in relation to the angular spacing between balls 123 results in a reduction in maximum backlash compared to many other designs. The balls 123 are staggered in relation to the pockets 127 in such a fashion that there always exists one ball 123 that is within 15° of a pocket, and another that is an additional 15° from a second pocket. Because of the additional requirement of this clutch that the ball 123 must fall into the pocket 127 (i.e., gravity must pull the ball into the pocket), only one of these two balls 123 can be guaranteed to be orientated properly such that it will engage. Therefore, the maximum backlash of this mechanism is 30°. In comparison, a three-ball clutch with nine pockets 127 does not have the staggered ball-to-pocket geometry, and would have a maximum backlash of 40°.

The media sheet moves through the paper path 39 at a set velocity (i.e., process speed) to reach the second transfer point 50 at the desired time to receive the toner image. In one embodiment, the process speed of the paper path 39 is about 110 millimeters per second (mm/s) resulting in an output from the device 9 of about 20 pages per minute (ppm) with about a two inch gap between media sheets. In one embodiment, the process speed of the paper path 39 is about 55 mm/s resulting an output of about 10 ppm with about a two inch gap. Proper timing results in the outputted sheet having a top writing line margin with acceptable tolerance.

In one embodiment, the speed of one or more sections of the paper path 39 can be adjusted when it is determined that the media sheet is leading or lagging the toner image. Once the trailing edge of the preceding media sheet has exited the last driven roll of a section, the speed of the section can be adjusted to remove positional error of the current sheet. This adjustment is referred to as a staging process. In one embodiment, a first adjustable section of the paper path 39 extends between sensor S1 and sensor S2, and a second adjustable section extends between sensor S2 and the second transfer point 50. The speed of the first adjustable section will be increased if the preceding page clears the section, and the media sheet has not reached sensor S1 at the expected time.

In one embodiment, controller 40 generates a fixed time interrupt at a predetermined interval, such as every one millisecond, to determine the error in the relationship between the media sheet and the toner image. The speed of the section of paper path 39 is then adjusted as needed to correct any error. In one embodiment, paper path speed corrections are accomplished by adjusting the speed of motor 69. One embodiment of a similar system and the staging process is disclosed in U.S. Pat. No. 6,519,443, assigned to Lexmark International, Inc., and herein incorporated by reference in its entirety.

To minimize top writing line margin error, controller 40 includes an algorithm for determining an estimated pick time. The estimated pick time is the expected time from when the drive assembly 110 is activated until the media sheet reaches a predetermined point along the paper path 39. In one embodiment, the estimated pick time is the time for a media sheet to be picked from the input tray 34 and made by sensor S2. The term "made" is understood to mean when a media path sensor senses the media sheet.

The algorithm incorporates variations in the clutch mechanism 120 caused by movement of the inner race 121 prior to engagement of the outer race 122 (i.e., angular backlash). In one embodiment, the algorithm factors that it is advantageous to pick the media sheet such that it usually matches or leads the toner image on the ITM belt 22. One reason for early picking is the controller 40 is more able to eliminate positional error of the media sheet within the paper path 39 when the media sheet is ahead of the toner image than when it is behind (i.e., the media sheet must be slowed below process speed prior to intersecting the toner image at the second transfer point 50). Additionally, the paper path motor 69 and gears (not shown) are quieter when operating at or below process speed.

A number of different parameters are used for determining the pick timings. The parameters include:

Actual Pick Time: the sensed time duration to pick a media sheet and move the sheet to a predetermined position along the media path. In one embodiment when the media sheet reaches the predetermined position early, the actual pick time is the time from when the drive assembly 110 is activated until sensor at the predetermined position is made. In another embodiment when the media sheet reaches the predetermined position late, the amount of time is interpreted based on normalizing the acceleration of the paper path rollers as defined in U.S. Pat. No. 6,519,443 already incorporated herein in its entirety.

Estimated Pick Time: the calculated estimated pick time for the next media sheet to be picked and moved to the predetermined position.

Previous Estimated Pick Time: the Estimated Pick Time for the last media sheet that reached the predetermined position.

Calculated Pick Time: the Actual Pick Time of the previous picked sheet then limited to within a preset window defined by the Upper Limit and the Lower Limit.

Pick Mechanism Variation: the maximum variation the angular backlash impacts the time required to pick a media sheet from the input tray 34. In one embodiment, the value is 73 milliseconds (msec) when using a rate of 20 ppm.

Maximum Decrement the maximum amount the Estimated Pick Time can decrease on a page-to-page basis. In one embodiment, the value is 36 msec for a rate of 20 ppm.

Maximum Increment the maximum amount the Estimated Pick Time can increase on a page-to-page basis. In one embodiment, the value is 73 msec for a rate of 20 ppm.

Upper Limit the upper limit that the Calculated Pick Time is set to if the Actual Pick Time is greater.

Lower Limit the lower limit that the Calculated Pick Time is set to if the Actual Pick Time is less.

In one embodiment, the algorithm updates the estimated pick time once a media sheet reaches the predetermined position. By way of example, the estimated pick time is updated when the media sheet makes sensor S2.

Figure 6:
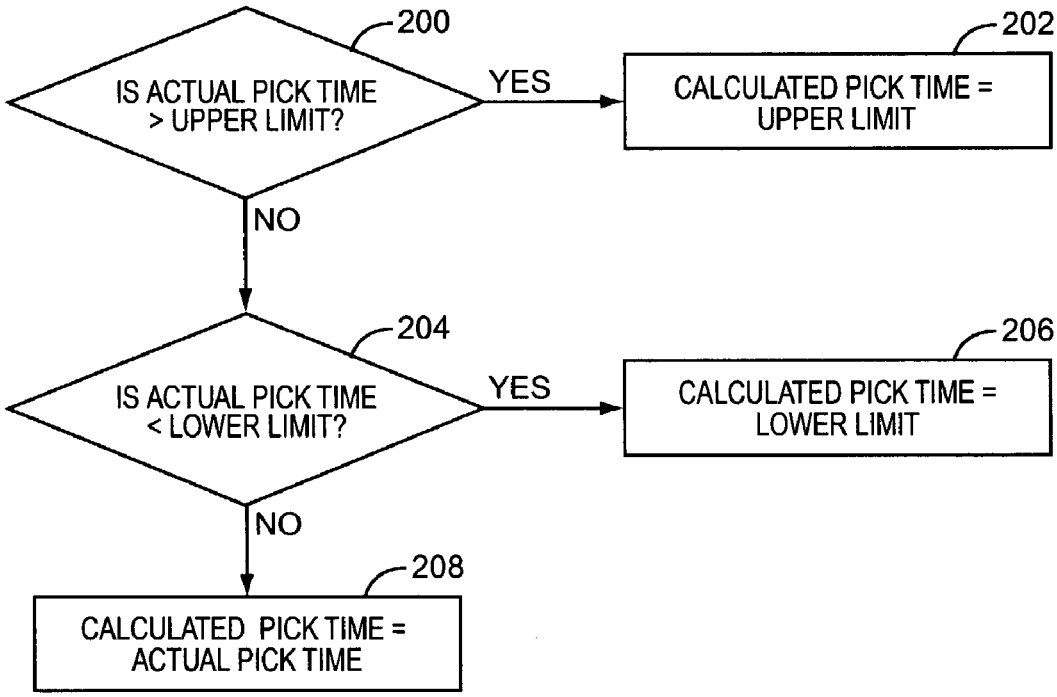
FIG. 6 is a flowchart diagram illustrating the steps of determining the calculated pick time according to one embodiment of the present invention.

FIG. 6 illustrates the first calculation of the pick algorithm that includes determining the Calculated Pick Time. The logic sets the calculated pick time to be within a predetermined window in the event the timing of the current media sheet is abnormal. In one embodiment, an abnormal reading results when the current media sheet is beginning to be picked by the pick mechanism 100 and a jam occurs at another location along the paper path 39. The device 9 is shut down and the pages cleared. If the current media sheet is not replaced completely into the input tray 34 and the machine is restarted, the media sheet will reach the predetermined point downstream within a shorter time period than a normal sheet which is picked when completely positioned within the input tray 34.

In one embodiment, the time calculations are all converted to a common speed. By way of example, the time calculations are converted and adjusted according to a paper path speed accommodating 20 ppm.

As illustrated in FIG. 6, the first step is determining whether the Actual Pick Time is greater than the Upper Limit (step 200). The Calculated Pick Time is set equal to the Upper Limit if the Actual Pick Time is greater than the Upper Limit (step 202). If the Actual Pick Time is not greater than the Upper Limit, it is then determined whether the Actual Pick Time is less than the Lower Limit (step 204). If this is true, the Calculated Pick Time is set equal to the Lower Limit (step 206). If the Actual Pick Time is not less than the Lower Limit and not greater than the Upper Limit, the Calculated Pick Time is set equal to the Actual Pick Time (step 208).

Figure 7:
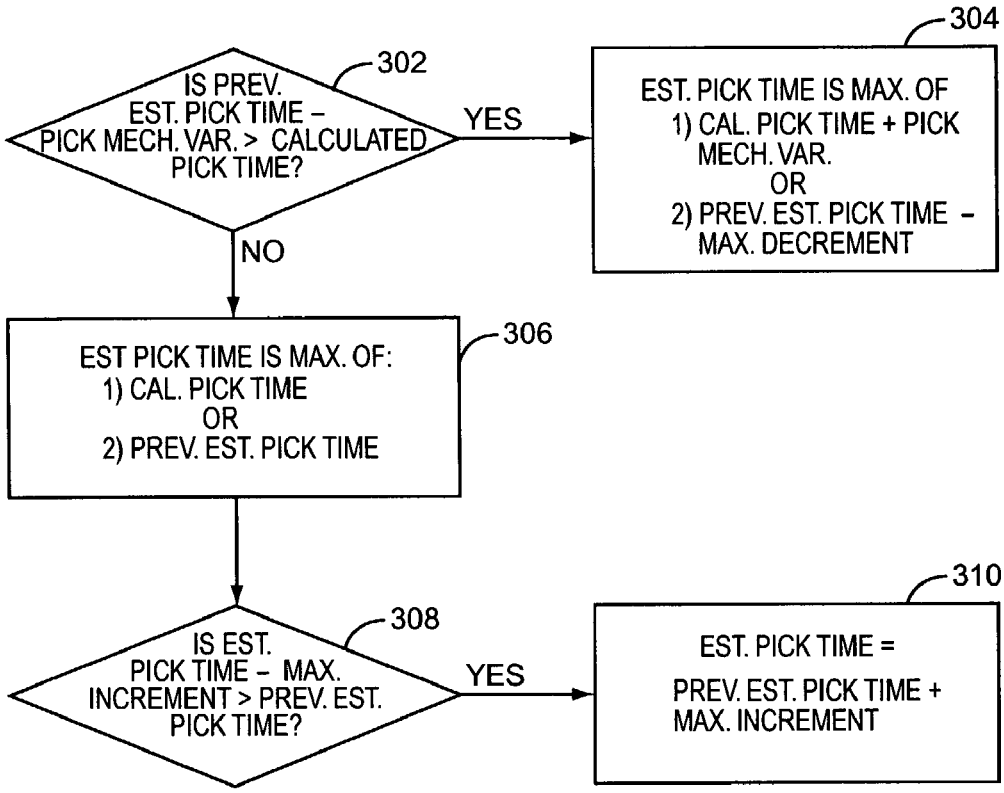
FIG. 7 is a flowchart diagram illustrating the steps of determining the estimated pick time according to one embodiment of the present invention.

Once the Calculated Pick Time is determined, the algorithm calculates the new Estimated Pick Time. The Estimated Pick Time is used by the controller 40 for determining when to activate the drive assembly 110 to pick the next media sheet. FIG. 7 illustrates the steps of the second part of the algorithm. The first step determines whether the Previous Estimated Pick Time less the Pick Mechanism Variation is greater than the Calculated Pick Time (step 302). If this is true, the Estimated Pick Time is the maximum of either: 1) the Calculated Pick Time plus the Pick Mechanism Variation; or 2) the Previous Estimated Pick Time less the Maximum Decrement (step 304).

If the Previous Estimated Pick Time less the Pick Mechanism Variation is not greater than the Calculated Pick Time, the preliminary Estimated Pick Time is the maximum of either: 1) the Calculated Pick Time; or 2) the Previous Estimated Pick Time (step 306). It is then determined if the preliminary Estimated Pick Time less the Maximum Increment is greater than the Previous Estimated Pick Time (step 308). If this is true, then the new Estimated Pick Time is the Previous Estimated Pick Time plus the Maximum Increment (step 310). The preliminary Estimated Pick Time becomes the Estimated Pick Time when the preliminary Estimated Pick Time less the maximum Increment is not greater than the Previous Estimated Pick Time In one embodiment, the algorithm updates the estimated pick time once a media sheet reaches the predetermined position. By way of example, the estimated pick time is updated when the media sheet makes sensor S2.

EXAMPLE 1

Paper Path Speed: 20 pages per minute.
Paper Path Rate: 110 mm/s
Pick Mechanism Variation: 73 msec
Maximum Decrement: 36 msec
Maximum Increment: 73 msec
Previous Estimate Pick Time: 1700 msec
Actual Pick Time: 1600 msec
Upper Limit: 2500 msec
Lower Limit: 1000 msec.
Is 1600>2500? (step 200): No
Is 1600<1000 ? (step 204): No
Calculated Pick Time=1600 msec (step 208)
Is 1700-73>1600 (step 302): Yes
Estimated Pick Time is maximum of either: 1) 1600+73; or 2) 1700−36 (step 304)
Estimated Pick Time=1673 msec

EXAMPLE 2

Figure 8:
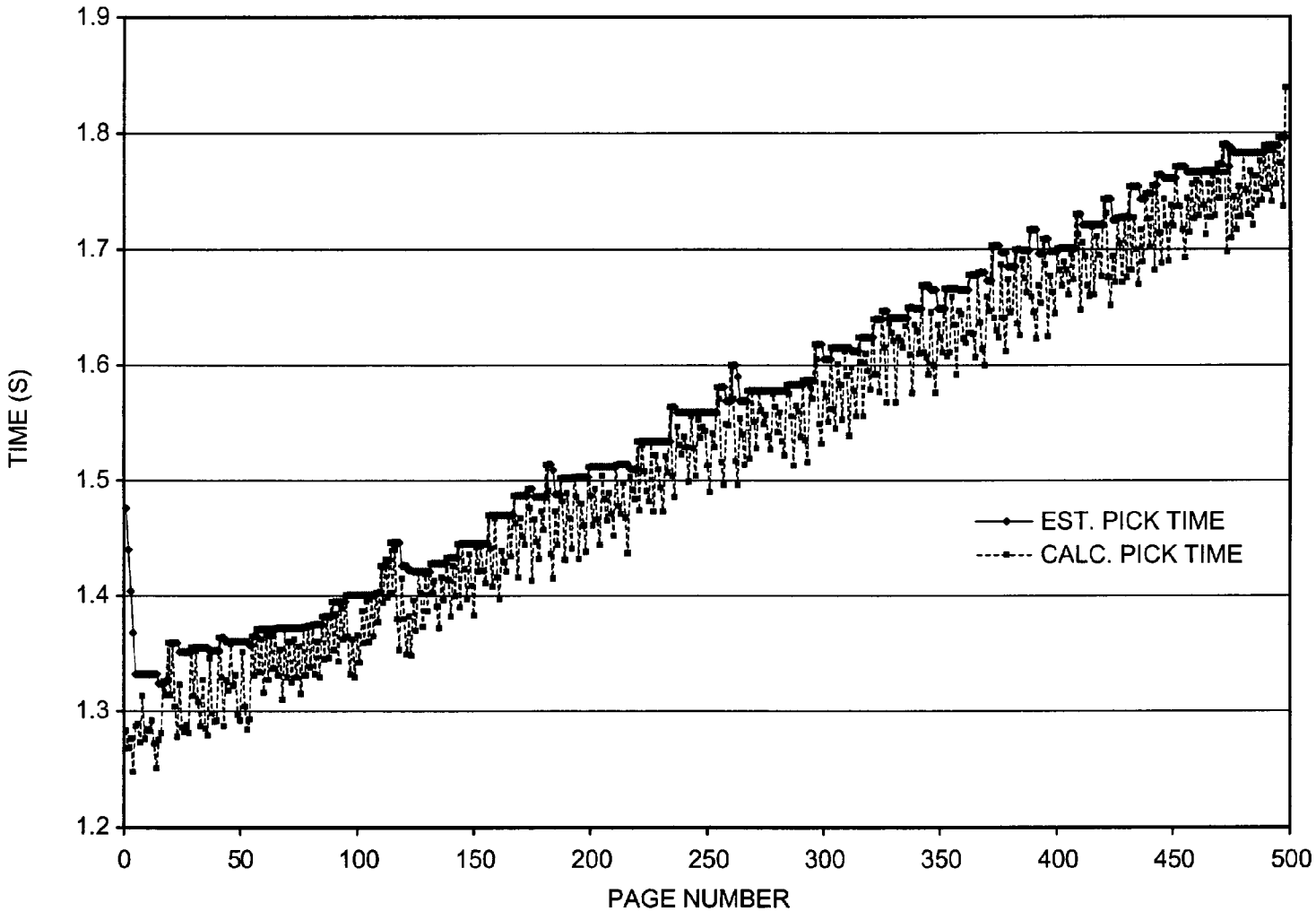
FIG. 8 is a chart illustrating results of testing of one embodiment of the pick mechanism and algorithm according to one embodiment of the present invention.

Paper Path Speed: 20 pages per minute.
Paper Path Rate: 110 mm/s
Pick Mechanism Variation: 73 msec
Maximum Decrement: 36 msec
Maximum Increment: 73 msec
Previous Estimate Pick Time: 1700 msec
Actual Pick Time: 1800 msec
Upper Limit: 1850 msec
Lower Limit: 1200 msec.
Is 1800>1850? (step 200): No
Is 1800<1200 ? (step 204): No
Calculated Pick Time=1800 msec (step 208)
Is 1700−73>1800 (step 302): No
Preliminary Estimated Pick Time is maximum of: 1) 1800; or 2) 1700 (step 306)
Preliminary Estimated Pick Time is 1800
Is 1800−73>1700 (step 308): Yes
Estimated Pick Time=1700+73 (step 310)
Estimated Pick Time=1773 msec FIG. 8 illustrates test results of the estimated pick times using the algorithm. In this embodiment, the maximum increment was 73 msec, maximum decrement was 36 msec, and the pick mechanism variation was 73 msec. As illustrated, the algorithm results in the average estimated pick times being generally higher than the average calculated pick times. The algorithm causes the controller 40 to begin picking media sheets with the assumption of maximum angular backlash. This algorithm accommodates the deviations caused by the angular backlash of the clutch mechanism 120. The algorithm also provides for the paper path to usually run at or below process speed.

The results of FIG. 8 used a stack of about 500 media sheets within the input tray 34. The times for the earlier media sheets are less than the later sheets because as the stack is depleted, the travel distance of the media sheets increases (i.e., the height of the stack decreases resulting in additional travel distance for each media sheet).

In one embodiment, an estimated value is stored in the controller 40 for determining the pick time of the initial media sheet. The stored value is used for the first sheet and then adjusted by the algorithm for determining the pick timings of subsequent sheets. In one embodiment, the input tray 34 includes a media level sensor that determines a rough estimate of the number of media sheets remaining in the input tray 34. The estimates include: empty; one page to 10% full; 10% to 50% full; and 50% to 100% full. An estimated pick time corresponding to the rough estimate is used for the initial pick and then modified per the algorithm. In the embodiment of FIG. 8, the media level sensor estimated between 50% to 100% full, and the initial pick time of approximately 1.48 sec. was used to pick the initial media sheet.

In one embodiment, the pick mechanism variation, maximum decrement, and maximum increment are determined relative to the speed of pick mechanism 100. These values can be adjusted accordingly depending upon the parameters of the pick mechanism used within a specific device 9.

In the embodiment illustrated, the pick mechanism 100 includes two pick tires 106 mounted to the shaft 108. Various number of pick tires 106 may be used for picking a media sheet. Further, other shapes and dimensions are contemplated for the contact member which picks the topmost sheet. The clutch mechanism 120 can be located at different positions in the drivetrain. Further, one or more clutch mechanisms 120 may be positioned on the shaft 108 to control the movement of the pick tires 106.

In one embodiment, the position of the media sheets along the paper path 39 is determined as a function of timing. An initial sensor, e.g., sensor S3, determines the position of the media sheet as it leaves the input tray 34. Controller 40 determines the position of the media sheet as a function of the speed of the motors driving the paper path and time.

The present invention may be carried out in other specific ways than those herein set forth without departing from the scope and essential characteristics of the invention. The embodiment illustrated in FIG. 1 comprises separate cartridges for each different color. The present invention is not limited to this embodiment, and may also be applicable to image forming apparatus featuring a single cartridge. The present embodiments are, therefore, to be considered in all respects as illustrative and not restrictive, and all changes coming within the meaning and equivalency range of the appended claims are intended to be embraced therein.

What is claimed is:

1. A device to introduce media sheets into an image forming apparatus comprising:

an input tray sized to contain a stack of media sheets;

a drive assembly;

a controller that controls the drive assembly;

a clutch mechanism operatively connected with the drive assembly comprising a first race having a plurality of detents, a second race having a plurality of pockets, and a plurality of balls positioned between the first race and the second race; and a contact member operatively connected to the second race and positioned on a topmost sheet of the stack;

the clutch mechanism being operable between a first orientation in which the second race rotates with the first race, and a second orientation in which the second race rotates at a different rate than the first race, the races being sized for angular backlash when the clutch mechanism is originally operated in the first orientation;

the controller controls the drive assembly such that the drive assembly rotates the first race when the clutch mechanism is in the second orientation and as the second race rotates at the different rate.

2. The device of claim 1, further comprising a pick arm positioned over the stack and having a proximal end pivotally mounted to the image forming apparatus and a distal end sized to position the contact member against the topmost sheet of the stack.

3. The device of claim 1, wherein the clutch mechanism includes three balls.

4. The device of claim 3, wherein the clutch mechanism includes eight pockets spaced evenly around the second race at about 45 degree intervals.

5. The device of claim 1, wherein a largest radius of the first race is less than a smallest radius of the second race.

6. The device of claim 1, wherein each of the plurality of indents comprises a first edge and a second edge aligned to form an angle less than or equal to about ninety degrees.

7. The device of claim 1, wherein a depth of each of the plurality of pockets is less than a diameter of each of the plurality of balls.

8. The device of claim 1, further comprising an intermediate transfer medium to transfer an image to a second transfer point to intercept one of the media sheets.

9. The device of claim 1, wherein an odd plurality of balls are positioned between the first race and the second race.

10. A method of picking a media sheet from an input tray within an image forming apparatus using a pick mechanism having a first race positioned within a second race, the first race having an odd plurality of indents and the second race having a plurality of pockets each sized to capture one of an odd plurality of balls that are positioned between the first race and the second race, the method comprising the steps of:

activating a drive mechanism and rotating the first race within the second race;

aligning at least one of the plurality of odd number balls between the first race and one of the plurality of pockets causing rotation of the first race to be transferred to the second race;

rotating a contact member in contact with the media sheet within the input tray and moving the media sheet into a paper path at a first rate;

introducing the media sheet into the paper path and moving the media sheet at a second rate greater than the first rate; and rotating the second race at second rate while the first race rotates at the first rate.

11. The method of claim 10, further comprising moving the odd plurality of balls towards the indents and away from the plurality of pockets when the second race rotates at the second rate.

12. The method of claim 10, further comprising rotating the first race less than about 30° prior to aligning at least one of the plurality of odd number balls between the first race and one of the plurality of pockets causing rotation of the first race to be transferred to the second race.

13. A device to introduce media sheets into an image forming apparatus comprising:

an input tray sized to contain a stack of media sheets;

an arm positioned at the input tray and including a first pivoting end and a second end;

a shaft connected to the second end of the arm;

a drive assembly that extends through the arm to rotate the shaft;

a controller that controls the drive assembly;

a clutch mechanism operatively connected with the shaft comprising a first race having a plurality of detents, a second race having a plurality of pockets, and a plurality of balls positioned between the first race and the second race; and a contact member operatively connected to the second race and positioned on a topmost sheet of the stack;

the clutch mechanism being operable between a first orientation in which the second race rotates with the first race at a first rate, and a second orientation in which the second race rotates at a different rate than the first race while the first race is driven by the drive assembly, the controller controls the drive assembly to rotate the shaft and the first race at the different rate when the clutch mechanism is in the second orientation;

the first orientation initially includes rotation of the first race prior to rotation of the second race due to play between the first race and the second race;

the second orientation includes rotation of the first race at the first rate after the second race rotates at the different rate.

14. The device of claim 13, further comprising a second contact member operatively connected to the shaft and being positioned on a first side of the arm that is opposite from the contact member.

15. The device of claim 13, wherein the first race includes three detents and the three balls are positioned between the first race and the second race.

16. The device of claim 13, wherein the second race includes eight pockets spaced evenly at about 45 degree intervals.

17. A method of picking a media sheet from an input tray within an image forming apparatus using a pick mechanism having a first race positioned within a second race, the first race having an odd plurality of indents and the second race having a plurality of pockets each sized to capture one of an odd plurality of balls that are positioned between the first race and the second race, the method comprising the steps of:

rotating the first race;

aligning the plurality of odd number balls between the first race and the plurality of pockets causing rotation of the first race to be transferred to the second race;

rotating a contact member operatively connected to the second race and in contact with the media sheet within the input tray and moving the media sheet at a first rate;

thereafter, moving the media sheet at a second rate greater than the first rate; and rotating the second race at second rate while the first race rotates at the first rate.

18. The method of claim 17, further comprising stopping rotation of the first race and continuing rotation of the second race and the contact member.

19. The method of claim 17, wherein the step of rotating the second race at the second rate while the first race rotates at the first rate further includes moving the balls into indents with the first race and spacing the balls away from the second race.

* * * * *